US008651202B2

(12) United States Patent
Swadi et al.

(10) Patent No.: US 8,651,202 B2
(45) Date of Patent: Feb. 18, 2014

(54) PERCUSSION DRILLING ASSEMBLY HAVING A FLOATING FEED TUBE

(75) Inventors: Shantanu Swadi, Cypress, TX (US); Lance Underwood, Cypress, TX (US); Jack Marshall, Lost Creek, WV (US); Charles Dewey, Houston, TX (US); Kevin Harrington, Houston, TX (US)

(73) Assignee: Smith International, Inc., Houston, TX (US)

( * ) Notice: Subject to any disclaimer, the term of this patent is extended or adjusted under 35 U.S.C. 154(b) by 189 days.

(21) Appl. No.: 13/090,820

(22) Filed: Apr. 20, 2011

(65) Prior Publication Data

US 2011/0192650 A1 Aug. 11, 2011

Related U.S. Application Data

(62) Division of application No. 12/127,396, filed on May 27, 2008, now Pat. No. 7,950,475.

(51) Int. Cl.
*E21B 4/14* (2006.01)

(52) U.S. Cl.
USPC ..... 175/296; 175/297; 175/293; 175/299; 175/57

(58) Field of Classification Search
USPC ..... 175/293, 296, 299, 57, 90, 92; 173/110, 173/111
See application file for complete search history.

(56) References Cited

U.S. PATENT DOCUMENTS

| | | | | |
|---|---|---|---|---|
| 4,534,422 | A * | 8/1985 | Rear | 173/206 |
| 4,903,785 | A * | 2/1990 | Odoni et al. | 175/293 |
| 5,065,827 | A | 11/1991 | Meyers et al. | |
| 5,205,363 | A | 4/1993 | Pascale | |
| 6,062,322 | A | 5/2000 | Beccu et al. | |
| 6,131,672 | A * | 10/2000 | Beccu et al. | 173/91 |
| 7,950,475 | B2 * | 5/2011 | Swadi et al. | 175/293 |

OTHER PUBLICATIONS

Product Catalog 2005-2006; IMPAX Hammers and Hammer Bits; Smith Bits, Smith International, Inc., Houston, TX; copyright 2005; pp. 46-48.
DTH Hammer Maintenance Manual; Halco Group, Halco America, Inc., Benton, IL, Jan. 19, 1996; p. 30.
IMPAX Hammers & Bits; Smith Bits, Smith International, Inc., Houston, TX, Jan. 24, 2008.
2012 Product Catalog; Percussion Hammers and Bits; Smith Bits, Smith International, Inc., Houston, TX; copyright 2011; pp. 53-57.

* cited by examiner

*Primary Examiner* — James Sayre
(74) *Attorney, Agent, or Firm* — Osha • Liang LLP

(57) ABSTRACT

A percussion drilling assembly for boring into the earth is disclosed. The percussion drilling assembly includes a top sub, a casing coupled to the top sub, and a feed tube assembly disposed within the top sub and the casing. The feed tube assembly includes a non-rigid coupling having a throughbore and a tubular body disposed therein. The tubular body is translatable in the radial position and/or rotatable relative to a longitudinal centerline extending through the non-rigid coupling.

9 Claims, 8 Drawing Sheets

PERCUSSION DRILLING ASSEMBLY HAVING A FLOATING FEED TUBE

CROSS-REFERENCE TO RELATED APPLICATIONS

This patent application is a divisional patent application of U.S. patent application Ser. No. 12/127,396, filed on May 27, 2008.

BACKGROUND

1. Field of Art

The disclosure relates generally to percussion or hammer drilling assemblies for drilling applications, including those for recovery of oil and gas. More particularly, the disclosure relates to a feed tube disposed within a percussion drilling assembly for supplying pressurized fluid to reciprocate a piston, causing the piston to cyclically impact a drill bit that is coupled to the drilling assembly.

2. Background of Related Art

A percussion drilling assembly is typically coupled to the lower end of a rotatable drill string. The percussion drilling assembly includes a top sub coupled to the drill string, a driver sub which couples to a drill bit and a piston-cylinder assembly positioned therebetween. The piston-cylinder assembly includes a casing surrounding a piston that reciprocates within the casing. A feed tube assembly is suspended within the casing and supported by the top sub.

During operation of the percussion drilling assembly, the drill string rotates the percussion-drilling assembly with the drill bit coupled thereto. Pressurized fluid, such as compressed air or nitrogen, is delivered from the drill string through the feed tube to the upper and lower ends of the piston in an alternating fashion, causing the piston to reciprocate within the casing. When at its lowest position at the end of the downstroke, the piston impacts the drill bit, thereby causing the drill bit to impact the formation below the bit. As the drill bit alternately impacts and rotates against the formation, the drill bit crushes, breaks, and loosens formation material to create a borehole along a predetermined path toward a target zone where oil or gas, for example, may be recovered.

The coupling between the top sub and the feed tube is important to the function of the percussion drilling assembly for a number of reasons. The coupling enables the top sub to support the suspended feed tube. Examples of such couplings include a cross pin that is inserted through the lower end of the top sub and the upper end of the feed tube, such that the pin suspends the feed tube from the top sub. One limitation of this design is that the piston is rigidly attached to the top sub and any slight misalignments and errors in machining can result in side loading, which may lead to premature wear of the sliding components. In another design, the upper end of the feed tube includes a flange having an outer edge used to suspend the feed tube from a shoulder of the top sub. In this case, O-rings are used to provide limited flexibility to the arrangement, and additional complexity and components are required to suspend the feed tube, making it more difficult to service the hammer assembly. The lack of flexibility may exacerbate wear and thereby increase tolerances between mating components of the drilling assembly, such as the feed tube and the piston. In turn, increase in clearance between the mating components may result in decreased system efficiency.

The coupling between the top sub and the feed tube may also act as a seal. The top sub and casing are typically coupled by means of a threaded connection. Pressurized fluid supplied through the feed tube to reciprocate the piston occupies an upper chamber within the casing proximate the threaded connection. The coupling between the feed tube and the top sub may provide a seal that protects the threads from exposure to the pressurized fluid, and prevents loss of pressurized fluid through this connection. The absence of an effective seal at this location may result in loss of fluid pressure to reciprocate the piston, and thus loss of drilling efficiency, as well as corrosion to the threads, thereby reducing the service life of the percussion drilling assembly.

The coupling between the top sub and the feed tube also enables alignment of the feed tube within the piston. Misalignment of the feed tube within the piston reduces the efficiency of the percussion bit. Rigid couplings, such as a cross pin inserted through the top sub and feed tube, cannot accommodate for potential misalignment of the feed tube within the piston. Because of this, clearance between the feed tube and the piston is instead increased over the dimension that would otherwise be required to accommodate for potential misalignment of these components. Increasing the clearance between the feed tube and piston, however, reduces percussion bit efficiency due to increased leakage from the upper chamber to the lower pressure exhaust passage and increases manufacturing costs due to the additional machining required. Reduced efficiency, in turn, leads to a reduced rate of penetration (ROP) for the percussion drilling assembly, and thus increased drilling time and cost.

The length of time that a percussion drilling assembly may be employed before it must be changed depends upon its ROP and its durability. Increasing the ROP and the service life of the percussion drilling assembly will decrease drilling time and allow valuable oil and gas to be recovered more economically. Accordingly, feed tube assemblies that offer the potential to increase the ROP and the service life of the percussion drilling assembly would be particularly desirable.

SUMMARY OF THE DISCLOSED EMBODIMENTS

A percussion drilling assembly having a feed tube assembly is disclosed. In some embodiments, the percussion drilling assembly includes a top sub, a casing coupled to the top sub, and a feed tube assembly disposed within the top sub and the casing. The feed tube assembly includes a non-rigid coupling having a throughbore and a tubular body disposed therein. The tubular body is translatable in the radial direction and/or rotatable relative to a longitudinal axis extending through the coupling.

In some embodiments, the non-rigid coupling includes a first and a second spacer disposed adjacent opposite sides of a flanged portion of the tubular body, a first and a second flexible gasket adjacent the first and the second spacer, respectively, a third spacer adjacent the first flexible gasket, and a fourth spacer adjacent the second flexible gasket. The coupling further includes two pins, each extending through the fourth spacer in a direction substantially normal to a longitudinal centerline of the coupling. The pins are configured to limit translation of the coupling in the axial direction.

In other embodiments, the non-rigid coupling includes a first and a second spacer disposed adjacent opposite sides of a flanged portion of the tubular body, a flexible gasket adjacent the first spacer, and a third spacer adjacent the flexible gasket. The coupling further includes two pins. Each pin has an elongate body with two ends. A generally cylindrical surface and a flat surface extend between the two ends of each pin. Each pin is rotatable over its cylindrical surface, while its flat surface is adjacent the second spacer. The pins are configured to limit translation of the coupling in the axial direction.

In still other embodiments, the non-rigid coupling includes a cylindrical bushing and a locking mechanism adjacent the cylindrical bushing. The cylindrical bushing has a throughbore bounded at least in part by a spherically shaped inner surface and a longitudinal centerline extending therethrough. The locking mechanism is configured to limit translation of the cylindrical bushing in the axial direction. The tubular body has a spherical portion disposed within the throughbore of the cylindrical bushing, wherein the spherical inner surface of the cylindrical bushing receives the spherical portion of the tubular body.

Thus, embodiments described herein comprise a combination of features and advantages intended to address various shortcomings associated with certain prior devices. The various characteristics described above, as well as other features, will be readily apparent to those skilled in the art upon reading the following detailed description of the preferred embodiments, and by referring to the accompanying drawings.

BRIEF DESCRIPTION OF THE DRAWINGS

For a detailed description of the disclosed embodiments, reference will now be made to the accompanying drawings in which.

DETAILED DESCRIPTION OF THE DISCLOSED EMBODIMENTS

Figures 1A, 1B:
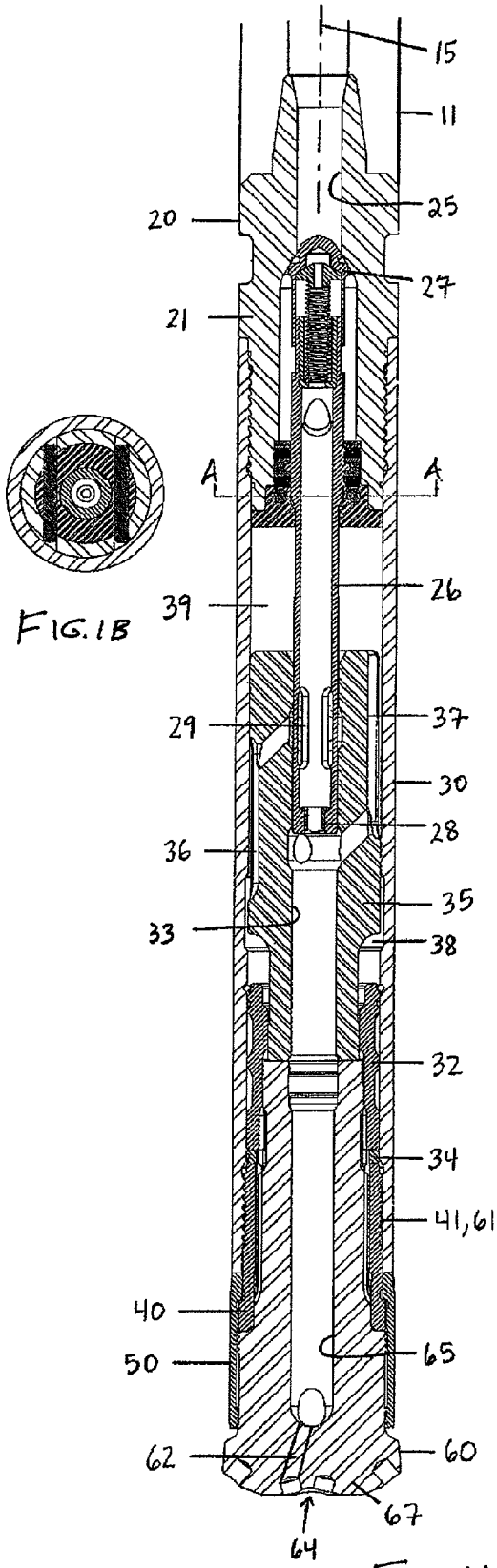
FIG. 1 is a cross-sectional view of a percussion drilling assembly including a feed tube assembly in accordance with the prior art principles described herein.

The following discussion is directed to various exemplary embodiments of the invention. Although one or more of these embodiments may be preferred, the embodiments disclosed should not be interpreted, or otherwise used, as limiting the scope of the disclosure, including the claims. In addition, one skilled in the art will understand that the following description has broad application, and the discussion of any embodiment is meant only to be exemplary of that embodiment, and not intended to suggest that the scope of the disclosure, including the claims, is limited to that embodiment.

Certain terms are used throughout the following description and claims to refer to particular features or components. As one skilled in the art will appreciate, different persons may refer to the same feature or component by different names. This document does not intend to distinguish between components or features that differ in name but not function or structure. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus are to be interpreted to mean "including, but not limited to . . . ." Also, the term "couple" or "couples" is intended to mean either an indirect or direct connection. Thus, if a first device couples to a second device, that connection may be through a direct connection, or through an indirect connection via other devices and connections. Further, the terms "axial" and "axially" generally mean along or parallel to a central or longitudinal axis, while the terms "radial" and "radially" generally mean perpendicular to a central longitudinal axis.

Referring now to FIG. 1, a percussion drilling assembly including a floating feed tube assembly in accordance with the principles disclosed herein is shown in cross-section. Percussion drilling assembly 10 includes a top sub 20, a driver sub 40, a tubular case 30 axially disposed between top sub 20 and driver sub 40, a piston 35 disposed in the tubular case 30, and a hammer bit 60 slidingly received by driver sub 40. Top sub 20, case 30, piston 35, driver sub 40, and hammer bit 60 are generally coaxially aligned, each sharing a common central or longitudinal axis 15.

Top sub 20 includes a body 21 having a central throughbore 25. Body 21 is threadingly coupled to the upper end of case 30 and the lower end of a drillstring 11. Central throughbore 25 enables fluid communication with drillstring 11. A feed tube assembly 26 in accordance with the principles disclosed herein extends axially from the bottom of body 21 into case 30. Coupling feed tube assembly 26 to top sub 20 in this manner allows simultaneous extraction of feed tube assembly 26 with top sub 20 when top sub 20 is uncoupled from casing 30. This facilitates disassembly of these components, as well as their assembly.

A check valve 27 disposed in bore 25 at the upper end of feed tube assembly 26 allows one-way fluid communication between bore 25 and feed tube assembly 26. In particular, check valve 27 allows fluid to flow downward from drillstring 11 throughbore 25 into feed tube assembly 26, but restricts backflow from feed tube assembly 26 into bore 25 and drillstring 11. In this manner, check valve 27 serves to restrict and/or prevent the back flow of drilled cuttings into drillstring 11. In some embodiments, a choke may also be provided either as drillable into the feed tube or as a separate piece to regulate fluid flow rates and/or upstream pressures. In the embodiment of FIG. 1, a choke 28 is included at the lower end of feed tube assembly 26 to partially or wholly direct fluid through ports 29 and into the working section of the hammer, i.e., upper and lower chambers, 39, 38, respectively, both described below.

Referring still to FIG. 1, the lower end of case 30 is threadingly coupled to the upper end of driver sub 40. Piston 35 is adapted for reciprocating motion and is disposed in case 30 above hammer bit 60 to cyclically impact hammer bit 60, as will be described in more detail below. Piston 35 includes a central throughbore 33 that slidingly receives the lower end of feed tube assembly 26, a first set of flow passages 36 in fluid communication bore 33, and a second set of flow passages 37 in fluid communication with bore 33. Flow passages 36 are in fluid communication with a lower chamber 38 defined by case 30 and the lower end of piston 35, while flow passages 37 are in fluid communication with an upper chamber 39 defined by case 30 and the upper end of piston 35. During drilling operations, piston 35 is cyclically actuated within case 30 by alternating the flow of the pressurized fluid, e.g., air or nitrogen, between flow ports 36, 37 and chambers 38, 39, respectively, as will be described in more detail below.

A guide sleeve 32 and a bit retainer ring 34 are also positioned in case 30 above driver sub 40. Guide sleeve 32 slidingly receives the lower end of piston 35. Bit retainer ring 34 is disposed about the upper end of hammer bit 60 and provides primary retention for hammer bit 60 when it drops to its off-bottom position.

Hammer bit 60 slideably engages driver sub 40. A series of generally axial mating splines 61, 41 on bit 60 and driver sub 40, respectively, allow bit 60 to move axially relative to driver sub 40 while simultaneously allowing driver sub 40 to rotate bit 60 with drillstring 11, top sub 20 and case 30. A retainer sleeve 50 is coupled to driver sub 40 and extends along the outer periphery of hammer bit 60. As described in U.S. Pat. No. 5,065,827, the entire disclosure of which is hereby incorporated herein by reference, the retainer sleeve 50 generally provides a secondary catch mechanism that allows the lower enlarged head 67 of hammer bit 60 to be extracted from the wellbore in the event of a breakage of the enlarged bit head.

In addition, hammer bit 60 includes a central longitudinal bore 65 in fluid communication with downwardly extending passages 62 which terminate in ports 64 formed in the face of hammer bit 60, or nozzles disposed in such ports 64. Bore 65 is also in fluid communication with bore 33 of piston 35. Guide sleeve 32 maintains fluid communication between bores 33, 65 as piston 35 moves axially upward relative to hammer bit 60. Pressurized fluid exhausted from chambers 38, 39 into main bore 33 of piston 45 flows throughbore 65, passages 62 and out ports 64. Together, passages 62 and ports 64 serve to distribute pressurized fluid around the face of bit 60 to flush away formation cuttings during drilling and to remove heat from bit 60.

During drilling operations, a pressurized fluid, e.g., air or nitrogen, is pumped down drillstring 11 throughbore 25, check valve 27, and feed tube assembly 26 to ports 29. Piston 35 is axially actuated between a lowermost or first position, where the lower end of piston 35 engages the upper end of hammer bit 60, and an uppermost or second position by alternating the flow of the pressurized fluid between flow ports 36, 37 and chambers 38, 39, respectively.

In particular, when piston 35 is in the lowermost position, feed tube assembly 26 and radial ports 29 are in fluid communication with flow passages 36 and lower chamber 38, while flow passages 37 and upper chamber 39 are in fluid communication with bores 33, 65. Thus, the pressurized fluid flows through ports 29 and flow passages 36 to lower chamber 38. Pressure in lower chamber 38 increases until it is sufficient to move piston 35 axially upward.

As piston 35 moves axially upward within case 30, the volume of upper chamber 39 decreases and the pressure in upper chamber 39 increases. However, the fluid in upper chamber 39 is exhausted through flow passages 37, bores 33, 65, downward passages 62, and exits hammer bit 60 via ports 64. As piston 35 continues to move axially upward, ports 29 eventually move out of alignment with flow passages 36, and thus, pressurized fluid is no longer provided to lower chamber 38. At about the same time, ports 29 move into alignment with flow passages 37, and the lower end of piston 35 is disposed axially above the upper end of guide sleeve 32. The flow of the pressurized fluid through ports 29 and flow passages 37 into upper chamber 39 serves to retard the upward travel of piston 35. Piston 35 achieves the second position at the point it ceases its upward movement. When piston 35 is in the uppermost position, the pressurized fluid flows through ports 29 and flow passages 37 to upper chamber 39. Pressure in upper chamber 39 increases until it is sufficient to move piston 35 axially downward.

As piston 35 moves axially downward within case 30, the volume of lower chamber 38 decreases and the pressure in lower chamber 38 increases. However, since the lower end of piston 35 is disposed above guide sleeve 32, the fluid in lower chamber 38 is directly exhausted to bore 65, through downward passages 62, and exits hammer bit 60 via ports 64, or nozzles if provided. As piston 35 continues to move axially downward, ports 29 eventually move out of alignment with flow passages 37, and thus, pressurized fluid is not longer provided to upper chamber 39. Shortly thereafter, the lower end of piston 35 impacts the upper end of hammer bit 60, and ports 29 move into alignment with flow passages 36, marking the transition of piston 35 to its lowermost or first position. The described cycle repeats to deliver repetitive high energy blows to hammer bit 60.

It should also be appreciated that during drilling operations, drillstring 11 and percussion drilling assembly 10 are rotated. Mating splines 61, 41 on bit 60 and driver sub 40, respectively, allow bit 60 to move axially relative to driver sub 40 while simultaneously allowing driver sub 40 to rotate bit 60 with drillstring 11. The rotation of hammer bit 60 allows the cutting elements (not shown) of bit 60 to be "indexed" to fresh rock formations during each impact of bit 60, thereby improving the efficiency of the drilling operation.

Figure 2:
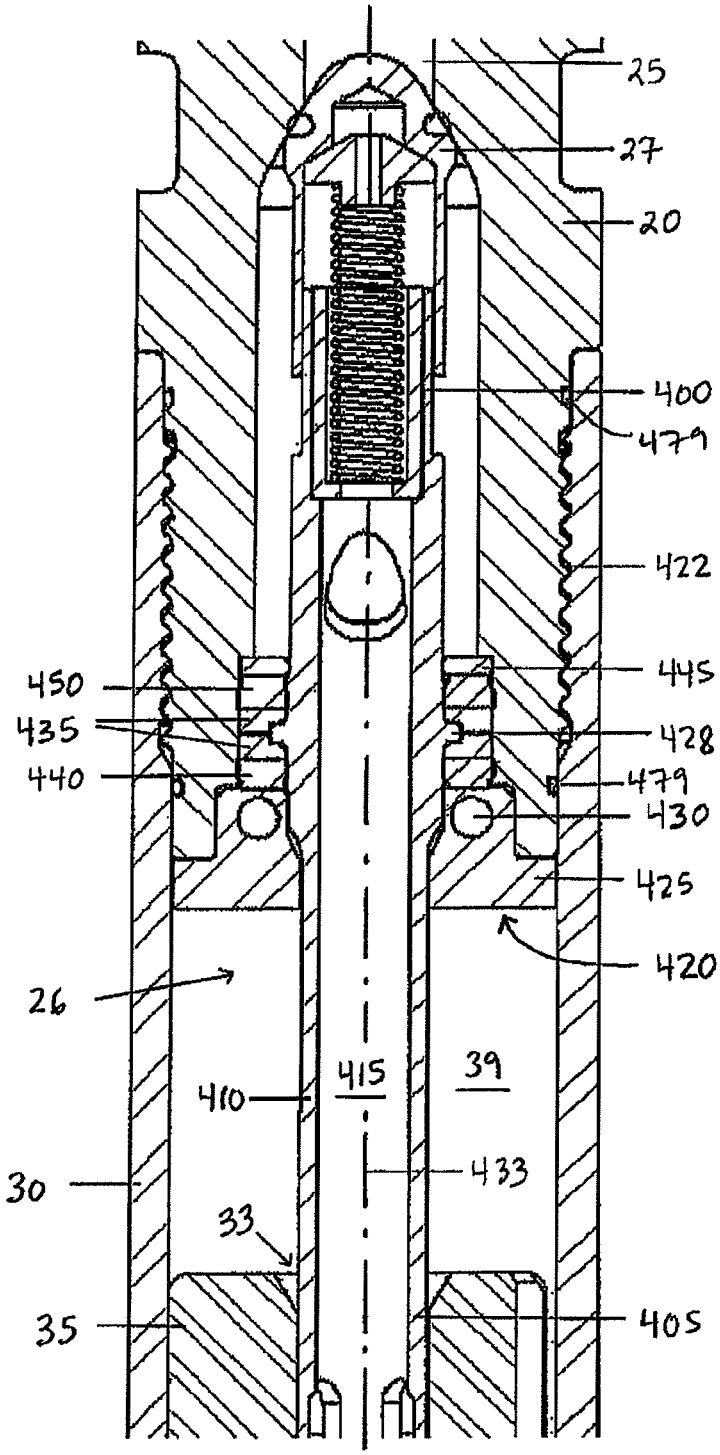
FIG. 2 is a cross-sectional view of the floating feed tube assembly of FIG. 1.

FIG. 2 depicts in greater detail feed tube assembly 26 of FIG. 1. As previously described, feed tube assembly 26 is disposed within top sub 20 and casing 30 between check valve 27 and piston 35. Feed tube assembly 26 includes a rigid tubular body 410 surrounding a flow bore 415 having a central longitudinal axis 433 that is generally aligned with longitudinal axis 15 (FIG. 1) of top sub 20. Tubular body 410 further includes an upper end 400, a lower end 405, and a flanged portion 428 extending radially outward proximate upper end 400, where the radial direction is generally normal to feed tube axis 433. In this exemplary embodiment, upper end 400 of tubular body 410 is coupled to check valve 27 by insertion of upper end 400 into check valve 27. In other embodiments, this coupling may take other equivalent forms. The lower end 405 of tubular body 410 is slideably received within bore 33 of piston 35. As pressurized fluid cyclically accumulates in and subsequently exhausts from chambers 39, 38 (FIG. 1), piston 35 translates axially downward and upward, respectively, within casing 30 by sliding about tubular body 410 of feed tube assembly 26, where the axial direction is generally parallel to feed tube axis 433.

Feed tube assembly 26 further includes an annular coupling 420 between the lower end of top sub 20 and tubular body 410 proximate upper end 400. Preferably coupling 420 is a non-rigid coupling that enables tubular body 410 of feed tube assembly 26 to suspend from the lower end of top sub 20 within casing 30. Coupling 420 includes a lower spacer 425, two intermediate spacers 435 disposed above lower spacer 425, and a lower gasket 440 disposed therebetween. Each intermediate spacer 435 is positioned on opposite sides of flanged portion 428 of tubular body 410. Coupling 420 further includes an upper spacer 445 disposed above intermediate spacers 435, and an upper gasket 450 disposed therebetween. In at least some embodiments, spacers 425, 435, 445 include a rigid material, such as but not limited to metal, and gaskets 440, 450 include a resilient flexible material, such as but not limited to, rubber. Further, spacers 425, 435, 445 and gaskets 440, 450 are each annularly shaped to receive tubular body 410, as shown.

To secure feed tube assembly 26 in position, as shown in FIG. 2, coupling 420 further includes at least one retention member. In this exemplary embodiment, the retention members are a pair of pins 430 extending generally radially through lower spacer 425. The ends of pins 430 engage mating location holes in top sub 20. Once top sub 20 is assembled within case 30, the bore of case 30 limits radial movement of pins 430.

Figure 3:
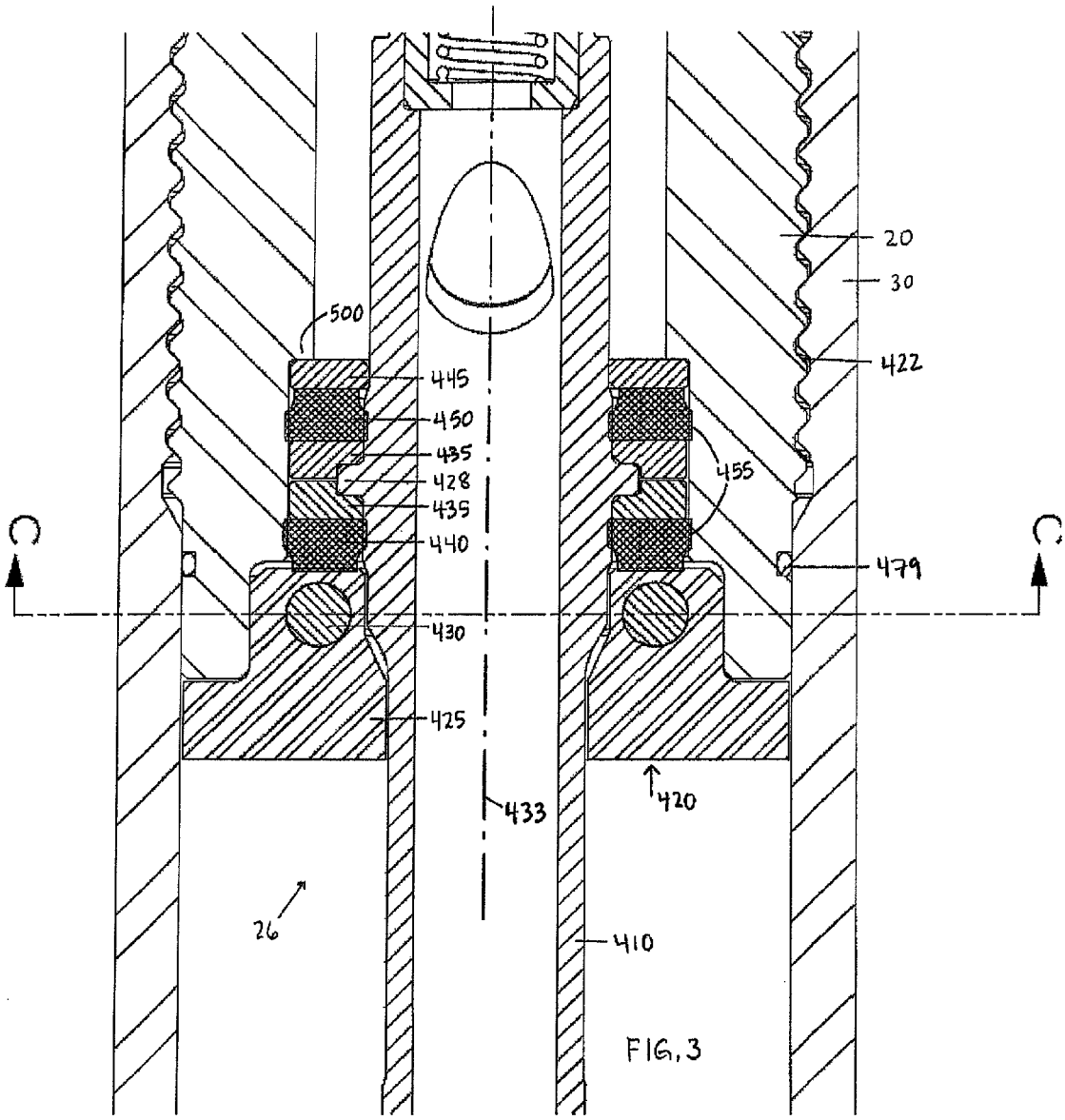
FIG. 3 is an enlarged, cross-sectional view of the floating feed tube assembly of FIG. 2.

FIG. 3 is an enlarged view of coupling 420 with tubular body 410 disposed therein. To suspend feed tube assembly 26 from top sub 20, as shown in FIG. 2, coupling 420 is assembled about tubular body 410. Feed tube assembly 26 is then inserted into bore 25 of top sub 20, such that upper spacer 445 abuts shoulder 500 of top sub 20 and upper end 400 of tubular body 410 is coupled to check valve 27, as previously described. To secure coupling 420 in this position, axial force is applied to lower spacer 425 to compress flexible gaskets 440, 450 against intermediate spacers 435 and/or upper spacer 445 and allow pins 430 extending through lower spacer 425 to engage the inner surface of case 30. Tubular body 410 of feed tube assembly 26 is also simultaneously secured in position within casing 30 by means of flanged portion 428 of tubular body 410 sandwiched between intermediate spacers 435 of coupling 420. Thus, pins 430 support the weight of feed tube assembly 26 as feed tube assembly 26 is suspended from top sub 20 within casing 30. Supporting feed tube assembly 26 in this manner eliminates the need to penetrate tubular body 410 of feed tube assembly 26, e.g., with a retaining pin.

Figure 4:
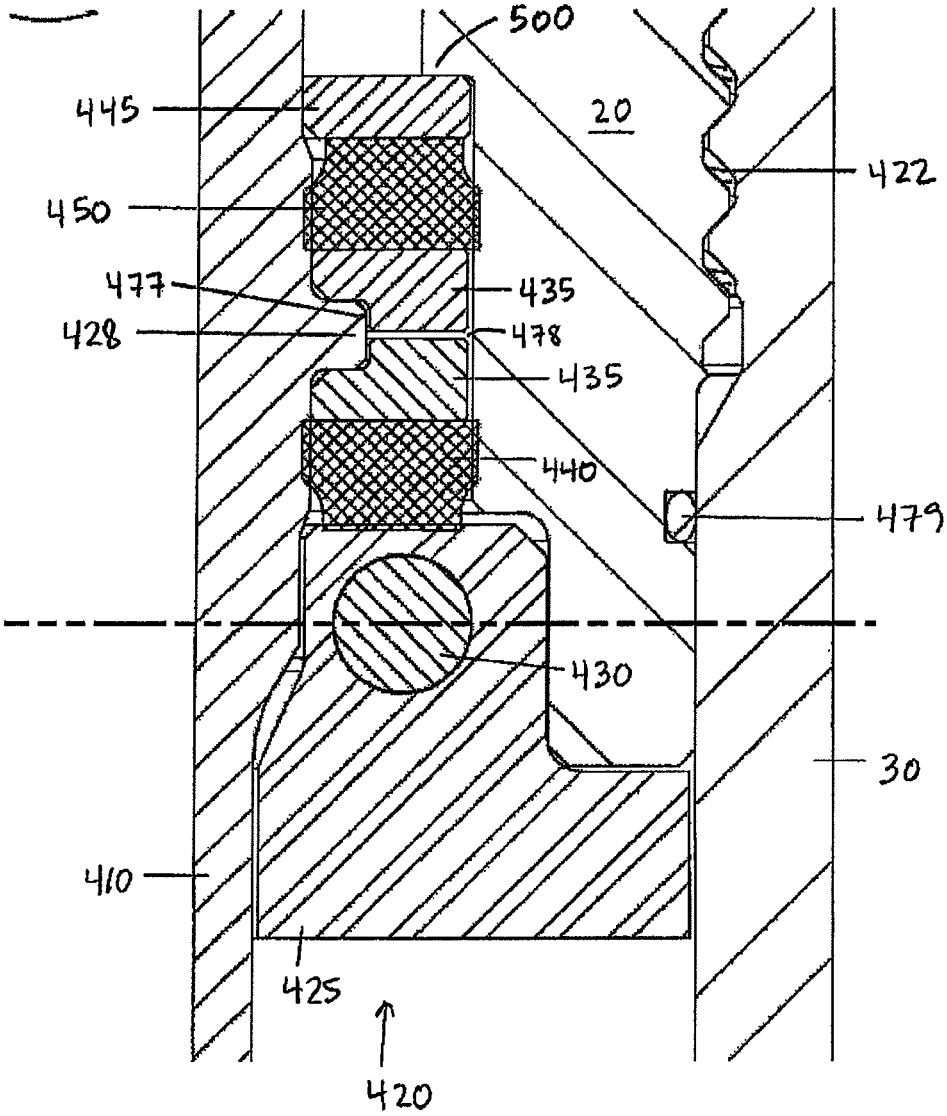
FIG. 4 is an enlarged, cross-sectional view of the coupling of the floating feed tube assembly of FIG. 2.

FIG. 4 is another enlarged view of coupling 420. Once feed tube assembly 26 is positioned within top sub 20, the flexible nature of gaskets 440, 450 and small radial clearances 477, 478 between spacers 425, 435, 445 of coupling 420 and tubular body 410, and between spacers 425, 435, 445 of coupling 420 and top sub 20, respectively, permit some limited radial movement of tubular body 410 within coupling 420. It is preferred that radial clearance be provided between coupling 420 and top sub 20 (radial clearance 478) or between coupling 420 and tubular body 410 (radial clearance 477) to promote assembly of these components. However, in some embodiments, the radial clearance may be divided between these two locations. Due to the flexibility of gaskets 440, 450 and radial clearances 477 and/or 478, coupling 420 is flexible and allows tubular body 410 to "float" within coupling 420 to accommodate potential radial misalignment of tubular body 410 relative to bore 33 (FIG. 2) of piston 35. At the same time, radial clearances 477, 478 are not wide enough to permit extrusion of and damage to gaskets 440, 450. In some embodiments, radial clearances 477, 478 may be approximately 0.010 to 0.020 inches to permit the necessary radial movement of tubular body 410 of feed tube assembly 26 so as to allow tubular body 410 to center itself within bore 33 of piston 35.

The flexible coupling of feed tube assembly 26 to top sub 20 eliminates the need for increased clearances between the sealing outer diameter of feed tube assembly 26 and bore 33 of piston 35 to facilitate assembly and allow for relative sliding between piston 35 and tubular body 410 of feed tube assembly 26 without excessive side loading of tubular body 410 relative to piston 35, as well as the associated increase in manufacturing costs. The flexible coupling also reduces cyclic stresses from side loading of feed tube assembly 26, which would otherwise reduce its service life. Furthermore, tubular body 410 of feed tube assembly 26 does not require a throughhole for a retaining pin, as is typical for some conventional feed tubes. In such cases, wear caused by the interaction of the retaining pin and the throughhole may reduce the service life of feed tube assembly 26 and create a leak path between upper chamber 39 and threads 422. Because feed tube assembly 26 does not require a throughhole in tubular body 410, threads 422 are more easily protected, in comparison to conventional feed tubes, by including at least one seal 479 below threads 422 and another seal 479 above threads 422 (FIG. 2).

Figure 5:
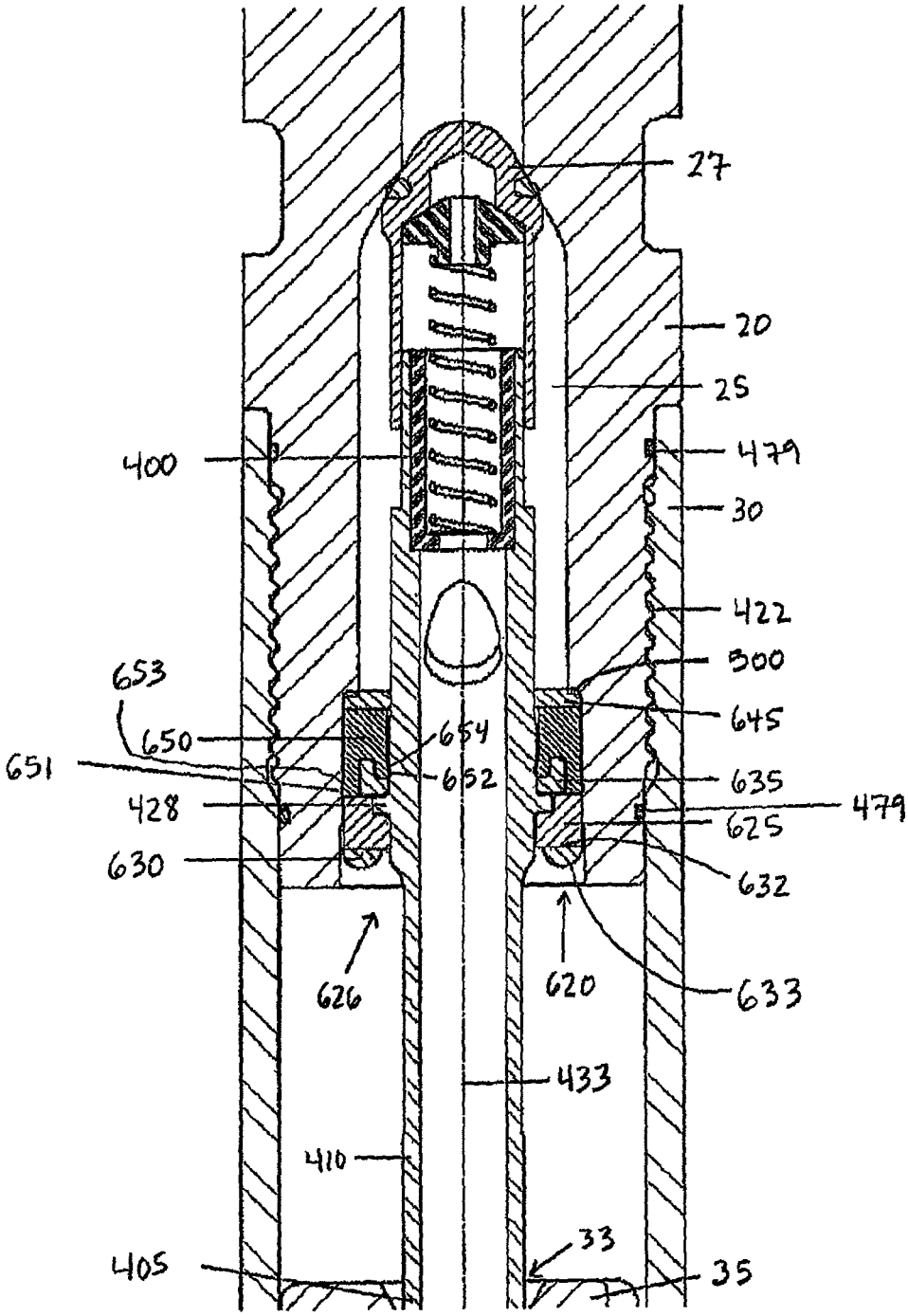
FIG. 5 is a cross-sectional view of another embodiment of a floating feed tube assembly.

Turning next to FIG. 5, another exemplary embodiment of a floating feed tube assembly is shown. In this example, floating feed tube assembly 626 includes tubular body 410, as described above, and an annular coupling 620. Coupling 620 functions similarly to coupling 420 described above, but differs in structure. Like coupling 420, coupling 620 is a non-rigid coupling that enables feed tube 626 to suspend from top sub 20 within casing 30 and, by virtue of its design, e.g., no throughhole required in tubular body 410, promotes protection of threads 422 at the coupling between top sub 20 and casing 30 from exposure to pressurized fluid.

Coupling 620 includes a lower spacer 625, an upper spacer 645, shown abutting shoulder 500 of top sub 20, and an intermediate spacer 635 disposed therebetween. An annular gasket 650 is disposed between spacers 625, 635, 645. Gasket 650 includes curved outer and inner surfaces 653, 654 with bumps 651, 652 formed thereon, respectively. The height of gasket 650 is selected to facilitate compression during the assembly process and sufficient preload in service. In one embodiment, gasket 650 may be integral with spacer 635 using a molding process. Lower spacer 625 and intermediate spacer 635 are positioned on opposite sides of flanged portion 428 of tubular body 410. Further, spacers 625, 635, 645 and gasket 650 are each annularly shaped to receive tubular body 410, as shown. In at least some embodiments, spacers 625, 635, 645 include a rigid material, such as but not limited to metal, and gasket 650 includes a resilient flexible material, such as but not limited to, rubber.

To secure feed tube assembly 626 in position, as shown in FIG. 5, coupling 620 further includes at least one retention member. In this exemplary embodiment, the retention members are a pair of pins 630, each having an elongate body having a generally cylindrical surface 633 and a flat surface 632. In contrast to pins 430 of coupling 420, pins 630 do not extend through lower spacer 625 but instead support lower spacer 625 along their flat sides 632. The ends of pins 630 engage a set of mating holes on the top sub 20 and are retained from radial movement by the bore of case 30.

Figure 6:
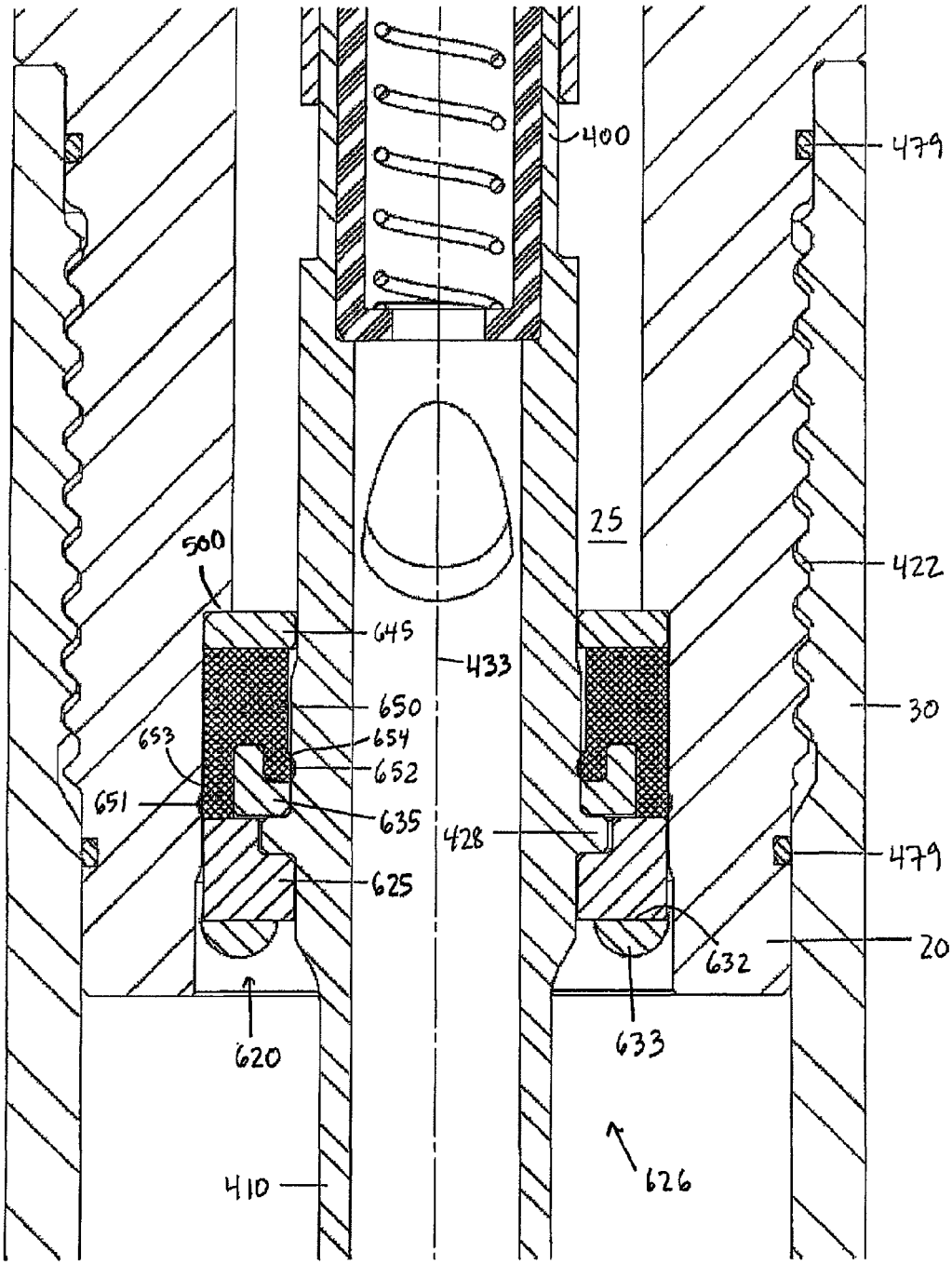
FIG. 6 is an enlarged, cross-sectional view of the floating feed tube assembly of FIG. 5.

FIG. 6 is an enlarged view of coupling 620 with tubular body 410 disposed therein. To suspend feed tube assembly 626 from top sub 20, as shown, coupling 620 is assembled about tubular body 410. Feed tube assembly 626 is then inserted into bore 25 of top sub 20, such that upper spacer 645 abuts shoulder 500 of top sub 20 and upper end 400 (FIG. 5) of tubular body 410 is coupled to check valve 27, as previously described. To secure coupling 620 in position, axial force is applied to pins 630 to compress flexible gasket 650 between spacers 625, 635, 645 and allow pins 630 to engage the inner surface of top sub 20. Tubular body 410 of feed tube assembly 626 is also simultaneously secured in position within casing 30 by means of flanged portion 428 of tubular body 410 sandwiched between lower 625 and intermediate 635 spacer of coupling 620. Thus, pins 630 support the weight of feed tube 626 as feed tube 626 is suspended within casing 30. Supporting feed tube 626 in this manner eliminates the need for penetrations through tubular body 410 of feed tube assembly 626.

Figure 7:
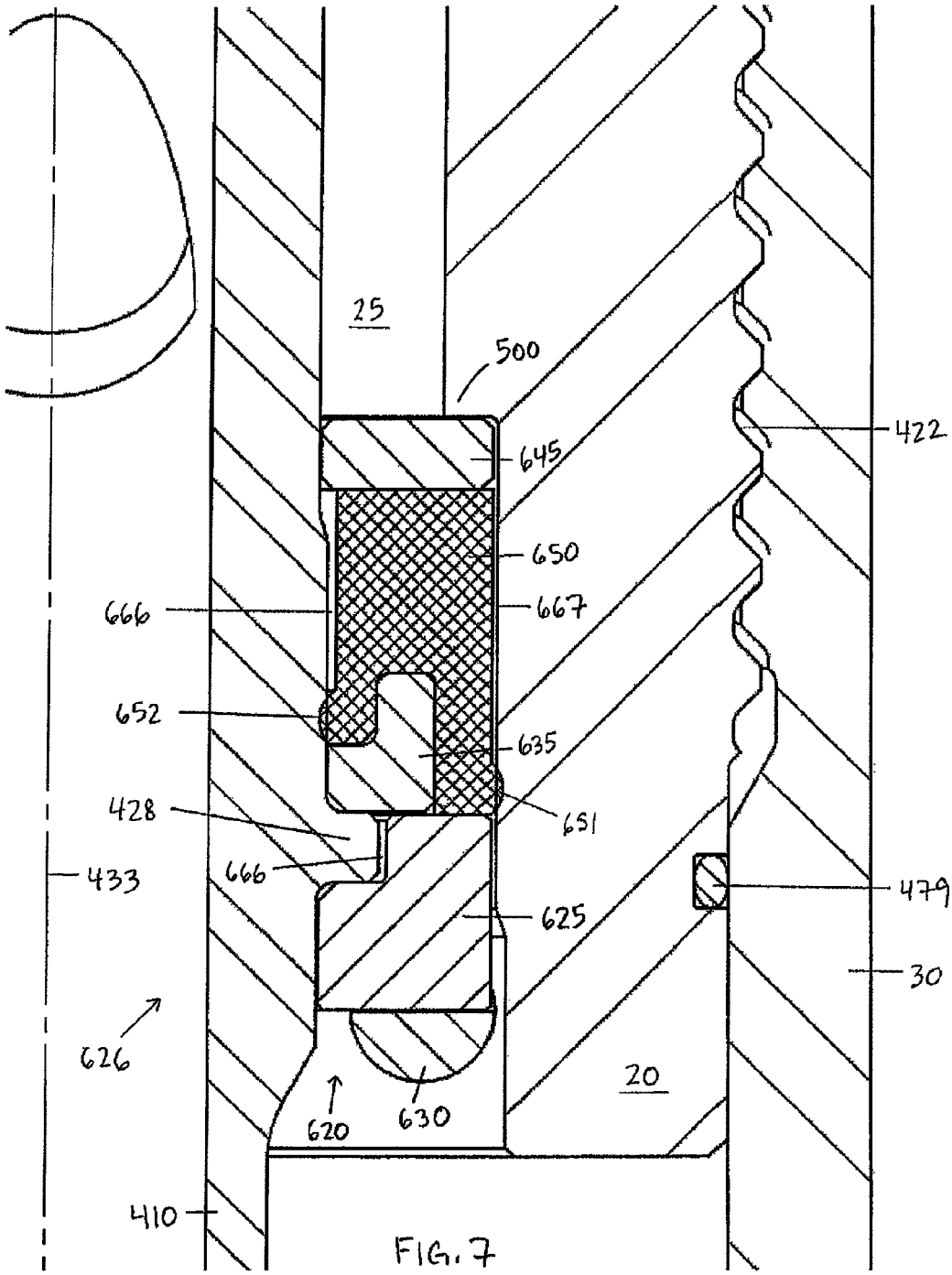
FIG. 7 is an enlarged, cross-sectional view of the coupling of the floating feed tube assembly of FIG. 5.

FIG. 7 is another enlarged view of coupling 620. Once feed tube assembly 626 is so positioned, the flexible nature of gasket 650 and small radial clearances 666, 667 between spacers 625, 635, 645 of coupling 620 and tubular body 410 and between spacers 625, 635, 645 and top sub 20, respectively, permit some limited radial movement of tubular body 410 within coupling 620. At the same time, these radial clearances 666, 667 are not wide enough to permit extrusion of and damage to gasket 650. Extrusion of flexible gasket 650 is controlled along tubular body 410 by spacer 635 and along top sub 20 by spacer 625. Further, because lower spacer 625 does not extend below pins 630, in contrast to lower spacer 425 of coupling 420, and due to the curved nature of bumps 651, 652 on gasket 650, flexible coupling 620 permits limited pivoting of feed tube assembly 626 to compensate for any angular misalignments between tubular body 410 of feed tube assembly 626 and bore 33 of piston 35 (FIG. 5). Thus, coupling 620 is flexible and allows tubular body 410 to "float" and pivot within coupling 620 to accommodate potential misalignment of feed tube assembly 626 relative to bore 33 of piston 35.

The flexible coupling of feed tube 626 to top sub 20 eliminates the need for increased clearances to accommodate for potential misalignment of feed tube assembly 626 relative to piston 35 and the associated increase in manufacturing costs. The flexible coupling also reduces cyclic stresses in feed tube assembly 626, which could otherwise reduce the service life of feed tube assembly 626. Moreover, tubular body 410 of feed tube assembly 626 does not require a throughhole for a retaining pin, the benefits of which are described above with reference to floating feed tube assembly 26.

Figure 8:
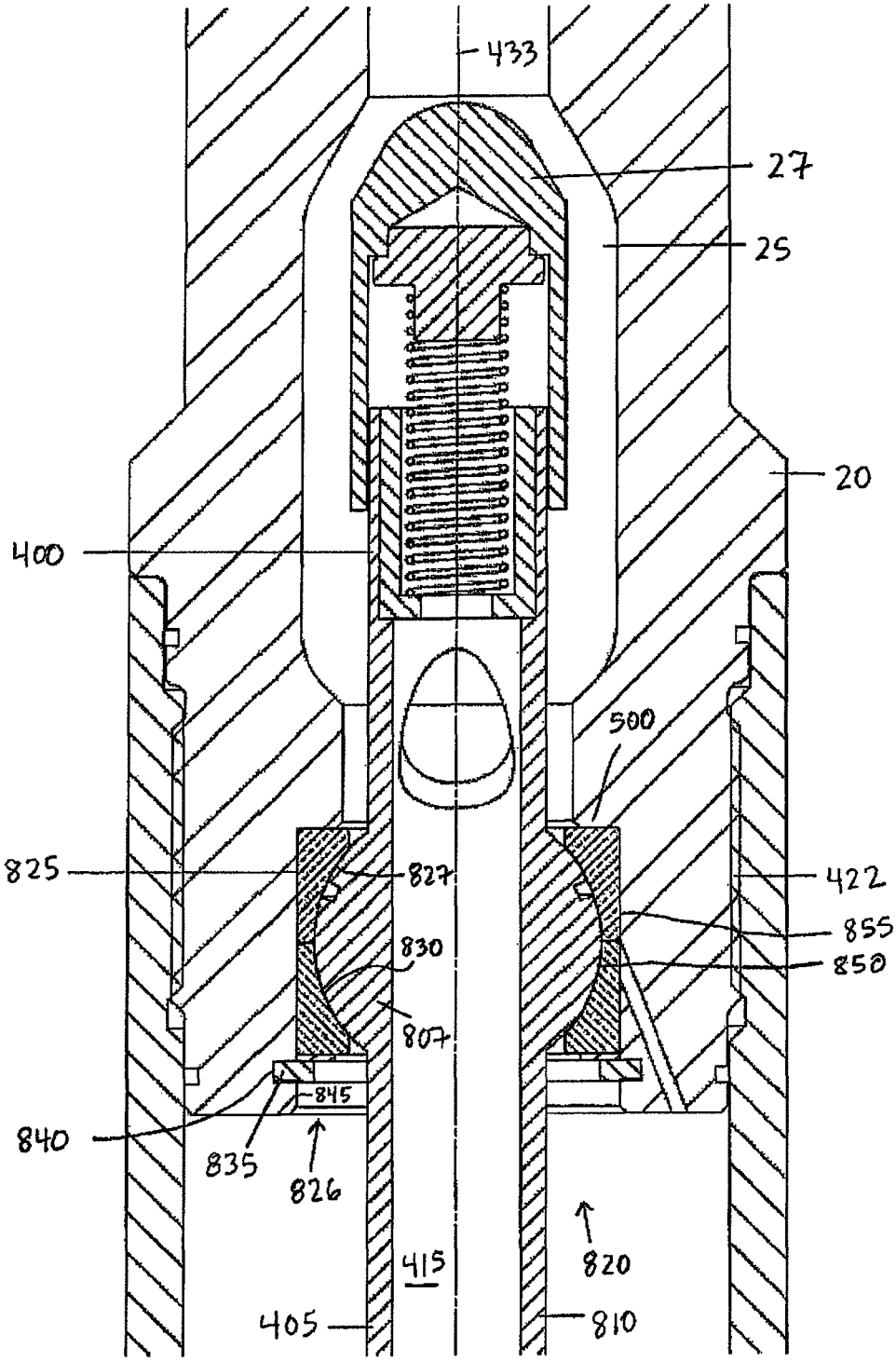
FIG. 8 is a cross-sectional view of yet another embodiment of a floating feed tube assembly.

FIG. 8 depicts yet another exemplary embodiment of a floating feed tube assembly. Feed tube assembly 826 includes a rigid tubular body 810 surrounding a flow bore 415 and having an upper end 400, a lower end 405 and a spherical portion 807 proximate upper end 400. As in previously described embodiments, upper end 400 of feed tube assembly 826 is coupled to check valve 27 by insertion of upper end 400 into check valve 27, and lower end 405 of feed tube 826 is slideably received by bore 33 of piston 35.

Feed tube assembly 826 further includes a coupling 820 between the lower end of top sub 20 and tubular body 810 proximate upper end 400. Coupling 820 is a non-rigid coupling that enables feed tube assembly 826 to suspend from top sub 20 within casing 30. Coupling 820 includes a cylindrical bushing 825 and a retaining ring 835. Cylindrical bushing 825 includes a throughbore 827 defined by an inner surface 830 configured to receive spherical portion 807 of tubular body 810. A locking mechanism coupled to the inner surface 845 of top sub 20 extends into bore 25 to support cylindrical bushing 825 and tubular body 810 disposed therein. In the embodiment illustrated by FIG. 8, the locking mechanism is a retaining ring. As shown, retaining ring 835 extends radially inward from an annular groove 840 along the inner surface 845 of top sub 20 to support cylindrical bushing 825. In some embodiments, cylindrical bushing 825 and retaining ring 835 each include a rigid material, such as but not limited to metal.

To suspend feed tube assembly 826 from top sub 20, cylindrical bushing 825 is assembled around tubular body 810 such that inner surface 830 of cylindrical bushing 825 receives spherical portion 807 of tubular body 810. Feed tube assembly 826 is then inserted into bore 25 of top sub 20, such that cylindrical bushing 825 of coupling 820 abuts shoulder 500 of top sub 20 and upper end 400 of tubular body 810 is coupled to check valve 27, as previously described. Retaining ring 835 is then inserted into groove 840 of top sub 20 to support cylindrical bushing 825 and tubular body 810 disposed therein. Supporting feed tube 826 in this manner eliminates the need for penetrations through tubular body 810 of feed tube 826.

Once feed tube 826 is so positioned, translational movement of feed tube assembly 826 is limited due to small clearances 850, 855 between cylindrical body 825 and spherical portion 807 of tubular body 810 and between cylindrical body 825 and top sub 20, respectively. However, due to the spherical shape of portion 807 of tubular body 810 and inner surface 830 of cylindrical bushing 825 which receives portion 807, tubular body 810 is permitted to pivot within coupling 820 to accommodate potential misalignment of feed tube 828 with bore 33 of piston 35.

Thus, the flexible coupling of feed tube assembly 826 to top sub 20 eliminates the need for increased clearances to accommodate for such misalignment and the associated increase in manufacturing costs. The flexible coupling also reduces cyclic stresses in feed tube 826, which could otherwise reduce the service life of feed tube 826. Further, tubular body 810 of feed tube assembly 826 does not require a throughhole for a retaining pin, the benefits of which are described above with reference to floating feed tube assembly 26

While various embodiments have been showed and described, modifications thereof can be made by one skilled in the art without departing from the spirit and teachings herein. The embodiments herein are exemplary only, and are not limiting. Many variations and modifications of the apparatus disclosed herein are possible and within the scope of the invention. Accordingly, the scope of protection is not limited by the description set out above, but is only limited by the claims which follow, that scope including all equivalents of the subject matter of the claims

What is claimed is:

1. A percussion drilling assembly for boring into the earth comprising:

a top sub;

a casing coupled to the top sub; and a feed tube assembly disposed within the top sub and the casing, the feed tube assembly comprising:

a non-rigid coupling having a throughbore; and a tubular body disposed therein;

wherein the tubular body is translatable in the radial direction and is pivotable relative to a longitudinal centerline extending through the non-rigid coupling; and wherein the non-rigid coupling interconnects the tubular body and the top sub and further comprises a retention member configured to limit translation of the non-rigid coupling in the axial direction, the retention member being a pin comprising: an elongate body having two ends; a generally cylindrical surface extending between the two ends, wherein the pin is rotatable over the cylindrical surface; and a flat surface extending lengthwise between the two ends, wherein the flat surface is adjacent a lower spacer of the non-rigid coupling.

2. The percussion drilling assembly of claim 1, wherein the non-rigid coupling further comprises an upper spacer and an intermediate spacer, wherein each of the upper spacer and the intermediate spacer comprises an outer diameter less than an inner diameter of the top sub, and wherein a radial clearance exists between each spacer and the top sub.

3. The percussion drilling assembly of claim 1, wherein the non-rigid coupling further comprises an upper spacer and an intermediate spacer, wherein each of the upper spacer and the intermediate spacer comprises an inner diameter greater than an outer diameter of the tubular body, and wherein a radial clearance exists between each spacer and the top sub.

4. The percussion drilling assembly of claim 1, wherein the non-rigid coupling further comprises a flexible gasket, the flexible gasket comprising at least one curved surface extending in substantially the radial direction.

5. The percussion drilling assembly of claim 1, wherein the non-rigid coupling further comprises a flexible gasket, wherein the flexible gasket is a seal between the top sub and the tubular body.

6. A percussion drilling assembly for boring into the earth comprising:

a top sub;

a casing coupled to the top sub; and a feed tube assembly disposed within the top sub and the casing, the feed tube assembly comprising:

a coupling comprising:

a cylindrical bushing with a throughbore bounded at least in part by a spherically shaped inner surface and having a longitudinal centerline extending therethrough; and a locking mechanism adjacent the cylindrical bushing, the locking mechanism being configured to limit translation of the cylindrical bushing in the axial direction; and a tubular body having a spherical portion disposed within the throughbore of the cylindrical bushing, wherein the spherically shaped inner surface of the cylindrical bushing receives the spherical portion of the tubular body;

wherein the tubular body is rotatable within the cylindrical bushing relative to the longitudinal centerline.

7. The percussion drilling assembly of claim 6, wherein the locking mechanism is a retaining ring.

8. The percussion drilling assembly of claim 6, wherein the coupling does not penetrate the tubular body.

9. A percussion drilling assembly for boring into the earth comprising:

a top sub having a longitudinal centerline extending therethrough;

a casing coupled to the top sub;

a feed tube assembly disposed within the top sub and the casing, the feed tube assembly comprising:

a tubular body; and a coupling interconnecting the tubular body to the top sub, the coupling comprising:

a first and a second spacer disposed adjacent opposite sides of a flanged portion of the tubular body;

a flexible gasket disposed adjacent the first spacer, the flexible gasket comprising at least one curved surface extending in substantially the radial direction;

a third spacer disposed adjacent the flexible gasket; and a pin comprising:

an elongate body having two ends, the two ends engaging the casing to limit translation of the coupling in the axial direction;

a generally cylindrical surface extending between the two ends, wherein the pin is rotatable over the cylindrical surface; and a flat surface extending lengthwise between the two ends, wherein the flat surface is adjacent the second spacer;

wherein the pin engages the casing to secure the coupling against a shoulder extending from an inner surface of the top sub; and wherein the tubular body is translatable in the radial direction and is pivotable relative to the longitudinal centerline.

* * * * *